US008212707B2

(12) United States Patent
Haga et al.

(10) Patent No.: US 8,212,707 B2
(45) Date of Patent: Jul. 3, 2012

(54) REMOTE CONTROL SYSTEM AND REMOTE CONTROL SIGNAL PROCESSING METHOD

(75) Inventors: Tsugihiko Haga, Tokyo (JP); Hiroto Kimura, Tokyo (JP); Masanori Machimura, Tokyo (JP); Koichiro Tsuji, Chiba (JP); Toshiyuki Hino, Tokyo (JP); Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 594 days.

(21) Appl. No.: 12/401,245

(22) Filed: Mar. 10, 2009

(65) Prior Publication Data

US 2009/0262001 A1 Oct. 22, 2009

(30) Foreign Application Priority Data

Apr. 16, 2008 (JP) ..... 2008-106981

(51) Int. Cl.
*G08C 19/00* (2006.01)

(52) U.S. Cl. ..... 341/176

(58) Field of Classification Search ..... 341/176
See application file for complete search history.

(56) References Cited

FOREIGN PATENT DOCUMENTS

JP 2003-110875 4/2003

*Primary Examiner* — Hal Kaplan
(74) *Attorney, Agent, or Firm* — Oblon, Spivak, McClelland, Maier & Neustadt, L.L.P.

(57) ABSTRACT

A remote control system is provided. The remote control system includes at least one first remote control apparatus and at least one second remote control apparatus. The at least one first remote control apparatus includes a command input unit, a first control unit, and a first output unit. The at least one second remote control apparatus includes a first user interface unit, a first input unit, a second control unit, and a second output unit.

15 Claims, 11 Drawing Sheets

FIG. 6

| OPERATION | VOICE COMMAND | CONTROL COMMAND |
|---|---|---|
| TV MODE | "TV" | TV_MODE |
| CHANNEL SWITCHING | "CHANNEL MODE" | TV_CHANNEL_MODE |
| ZAPPING | "ZAPPING MODE" | TV_ZAPPING_MODE |
| DVD MODE | "DVD" | DVD_MODE |
| PLAYBACK | "PLAYBACK MODE" | DVD_PLAY_MODE |
| CHAPTER SELECT | "CHAPTER SELECT MODE" | DVD_CHAPTER_MODE |
| POWER ON/OFF | "POWER"<br>"ON/OFF" | TOGGLE_POWER |
| OPERATION COMMAND ASSIGNMENT | "ASSIGNMENT" | COMMAND_ASSIGN |
| INCREASE VOLUME | "UP" | TV_VOLUME_UP |
| DECREASE VOLUME | "DOWN" | TV_VOLUME_DOWN |
| NEXT CHANNEL | "NEXT" | TV_CHANNEL_NEXT |
| PREVIOUS CHANNEL | "PREVIOUS" | TV_CHANNEL_PREV |
| FORWARD PICTURE SEARCH | "FORWARD SEARCH" | DVD_PLAY_NEXT |
| BACKWARD PICTURE SEARCH | "BACKWARD SEARCH" | DVD_PLAY_PREV |
| NEXT CHAPTER | "FORWARD" | DVD_CHAPTER_NEXT |
| PREVIOUS CHAPTER | "BACK" | DVD_CHAPTER_PREV |

FIG. 7

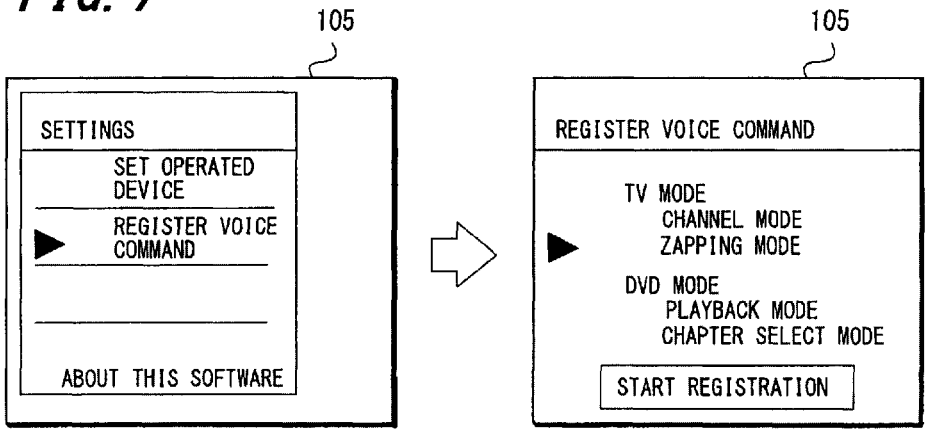

FIG. 8

| CONTROL COMMAND | OPERATION |
|---|---|
| TOGGLE_POWER | TOGGLE OPERATION BETWEEN LCD DISPLAY OFF AND LCD DISPLAY ON |
| COMMAND_ASSIGN | RECOGNIZE ASSIGNED COMMAND FROM VOICE COMMAND |
| TV_MODE | SWITCH TO CHANNEL SWITCHING MODE |
| TV_CHANNEL_MODE | DISPLAY PROGRAM GUIDE |
| TV_ZAPPING_MODE | DISPLAY HIDDEN PROGRAMS |
| TV_VOLUME_UP/DOWN | DISPLAY TV VOLUME LEVEL |
| TV_CHANNEL_PREV/NEXT | DISPLAY SELECTED TV CHANNEL |
| TV_CHANNEL_ZAPPING | SWITCH DISPLAY BETWEEN HIDDEN PROGRAMS |
| DVD_MODE | SWITCH TO DVD PLAYBACK MODE |
| DVD_PLAY_MODE | DISPLAY DVD SUBTITLE INFORMATION |
| DVD_CHAPTER_MODE | DISPLAY CHAPTER INDEX IMAGES |
| DVD_PLAY_PREV/NEXT | DISPLAY PICTURE SEARCH STATE |
| DVD_CHAPTER_PREV/NEXT | HIGHLIGHT DISPLAY OF SELECTED CHAPTER INDEX IMAGE |

FIG. 10

| CONTROL COMMAND | OPERATION |
|---|---|
| TOGGLE_POWER | TRANSMIT DEVICE CONTROL COMMAND "TOGGLE TV POWER" |
| COMMAND_ASSIGN | COMMAND ASSIGNING PROCESSING |
| TV_MODE | TRANSMIT DEVICE CONTROL COMMAND "SWITCH TV INPUT" |
| TV_VOLUME_UP/DOWN | TRANSMIT DEVICE CONTROL COMMAND "TV VOLUME UP/DOWN" |
| TV_CHANNEL_PREV/NEXT | TRANSMIT DEVICE CONTROL COMMAND "TV CHANNEL UP/DOWN" |
| TV_CHANNEL_ZAPPING | TRANSMIT DEVICE CONTROL COMMAND "TV CHANNEL UP" |
| DVD_MODE | TRANSMIT DEVICE CONTROL COMMAND "SWITCH TO DVD INPUT" |

FIG. 11

| CONTROL COMMAND | OPERATION |
|---|---|
| TOGGLE_POWER | TRANSMIT DEVICE CONTROL COMMAND "TOGGLE DVD POWER" |
| COMMAND_ASSIGN | COMMAND ASSIGNING PROCESSING |
| DVD_PLAY_MODE | TRANSMIT DEVICE CONTROL COMMAND "DVD PLAYBACK" |
| DVD_PLAY_PREV/NEXT | TRANSMIT DEVICE CONTROL COMMAND "DVD PICTURE SEARCH" |
| DVD_CHAPTER_PREV/NEXT | TRANSMIT DEVICE CONTROL COMMAND "NEXT/PREVIOUS DVD CHAPTER" |

FIG. 12A

| MODE | SUBMODE | CONTROL COMMAND |
|---|---|---|
| TV MODE | CHANNEL SWITCHING MODE | TOGGLE_POWER |
| | ZAPPING MODE | TV_CHANNEL_ZAPPING |

FIG. 12B

| MODE | SUBMODE | CONTROL COMMAND |
|---|---|---|
| DVD MODE | PLAYBACK MODE | DVD_PLAY_START/STOP |
| | CHAPTER SELECT MODE | DVD_PLAY_START/STOP |

FIG. 13A

| MODE | SUBMODE | BUTTON | CONTROL COMMAND |
|---|---|---|---|
| TV MODE | CHANNEL SWITCHING MODE | BUTTON 1 | TV_CHANNEL_PREV |
| | | BUTTON 2 | TV_CHANNEL_NEXT |
| | ZAPPING MODE | BUTTON 1 | TV_VOLUME_UP |
| | | BUTTON 2 | TV_VOLUME_DOWN |

FIG. 13B

| MODE | SUBMODE | BUTTON | CONTROL COMMAND |
|---|---|---|---|
| DVD MODE | PLAYBACK MODE | BUTTON 1 | DVD_PLAY_PREV |
| | | BUTTON 2 | DVD_PLAY_NEXT |
| | CHAPTER SELECT MODE | BUTTON 1 | DVD_CHAPTER_PREV |
| | | BUTTON 2 | DVD_CHAPTER_NEXT |

FIG. 18

| MODE | SUBMODE | CONTROL COMMAND |
|---|---|---|
| TV MODE | CHANNEL SWITCHING MODE | TOGGLE_POWER |

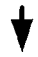

| MODE | SUBMODE | CONTROL COMMAND |
|---|---|---|
| TV MODE | CHANNEL SWITCHING MODE | TV_VOLUME_UP/DOWN |

FIG. 19A

| | CHANNEL SWITCHING MODE | ZAPPING MODE |
|---|---|---|
| DISPLAY UNIT | DISPLAY PROGRAM GUIDE | DISPLAY HIDDEN PROGRAMS |
| BUTTON UNIT | SWITCH POWER ON/OFF | NEXT CHANNEL |
| UP-DOWN BUTTON UNIT | SWITCH CHANNEL | ADJUST VOLUME |

FIG. 19B

| | PLAYBACK MODE | CHAPTER SELECT MODE |
|---|---|---|
| DISPLAY UNIT | DISPLAY SUBTITLES | DISPLAY HIDDEN PROGRAMS |
| BUTTON UNIT | SWITCH BETWEEN PLAY AND STOP | SWITCH BETWEEN PLAY AND STOP |
| UP-DOWN BUTTON UNIT | PICTURE SEARCH | SELECT CHAPTER |

REMOTE CONTROL SYSTEM AND REMOTE CONTROL SIGNAL PROCESSING METHOD

BACKGROUND OF THE INVENTION

1. Field of the Invention

The present invention relates to a remote control system and a remote control signal processing method, and in particular to a remote control system formed by including a plurality of remote control apparatuses and a remote control signal processing method used in such system.

2. Description of the Related Art

In recent years, television sets and recording/reproducing apparatuses, such as DVD (Digital Versatile Disc) recorders, that are equipped with a variety of functions aside from basic functions like switching channel and adjusting volume have become increasingly common. For example, a television set capable of receiving digital television broadcasts is equipped with a channel selecting function for switching between channels, an EPG (Electronic Program Guide) display function, and the like. Accordingly, a remote controller for controlling an apparatus equipped with a variety of functions has a large number of buttons corresponding to the various functions.

Also, since the number of electronic devices used in the home has increased, there are now cases where control functions for controlling a plurality of devices are provided in a single remote controller. Since such remote controller may need to control a variety of functions of a variety of electronic devices, the types and number of buttons on the remote controller will increase.

When a large number of buttons are provided on a single remote controller, there is such a disadvantage that operability for the user is reduced. That is, there is the problem of increased probability that the user will not know which button to press to realize the desired operation or will make an erroneous operation.

Japanese Unexamined Patent Application Publication No. 2003-110875, as one example, discloses a technology where user operability is improved by providing a subcontroller assigned with special functions in addition to a normal remote controller.

SUMMARY OF THE INVENTION

It is believed that by using the technology disclosed in Japanese Unexamined Patent Application Publication No. 2003-110875 and assigning the subcontroller to functions often used by the user, operability will be improved for the operations carried out using the subcontroller. However, functions that may not be controlled by the subcontroller need to be carried out using the normal remote controller. For example, in a case where the remote controller used as the "normal remote controller" has many operation interfaces of many types, operability may not be improved when using such remote controller.

It is desirable to provide a remote control system with improved operability.

According to an embodiment of the present invention, a first remote control apparatus includes a command input unit in which a user inputs a command, a first control unit that determines, based on the command inputted via the command input unit, a control command in accordance with a content of the command, and a first output unit that outputs the control command determined by the first control unit to another apparatus. A second remote control apparatus includes: a user interface unit that is a user interface portion and is assigned an operation for controlling one function in a plurality of functions of an operated device that is operated by the second remote control apparatus and an input unit in which a control command transmitted from the first remote control apparatus is inputted. The second remote control apparatus further includes a second control unit that carries out processing, based on an operation content inputted via the user interface unit and the control command inputted via the input unit, that was associated in advance with the operation content and the control command; and a second output unit operable when a device control command for controlling the operated device has been generated by the processing carried out by the second control unit, to output the device control command to the operated device.

With such construction, when a remote control system is formed by including a plurality of remote control apparatuses, a plurality of functions of the operated device are separately assigned to the respective remote control apparatuses.

Therefore, the remote control apparatuses will correspond to functions assigned thereto on a one-to-one basis.

According to an embodiment of the present invention, since the remote control apparatuses will correspond to functions assigned thereto on a one-to-one basis, the user will be able to select with certainty the remote control apparatus with the function that the user wishes to use. Accordingly, it is possible to prevent erroneous operations by the user and to improve user operability.

BRIEF DESCRIPTION OF THE DRAWINGS

FIG. 6 is a schematic diagram showing an example of a voice command-control command correspondence table according to an embodiment of the present invention.

FIG. 7 is a schematic diagram showing an example configuration of a GUI during registration of a voice command according to an embodiment of the present invention.

FIG. 8 is a schematic diagram showing an example of a control command-operation correspondence table of a display unit according to an embodiment of the present invention.

FIG. 10 is a schematic diagram showing an example of a control command-operation correspondence table of a button unit according to an embodiment of the present invention.

FIG. 11 is a schematic diagram showing an example of a control command-operation correspondence table of an up-down button unit according to an embodiment of the present invention.

FIGS. 12A and 12B are schematic diagrams showing examples of operation input-control command correspondence tables of a button unit according to an embodiment of the present invention.

FIGS. 13A and 13B are schematic diagrams showing example constructions of operation input-control command correspondence tables of an up-down button unit according to an embodiment of the present invention.

FIG. 18 is a schematic diagram showing an example of when a table is changed during the command assignment changing processing for a button unit.

FIGS. 19A and 19B are schematic diagrams showing examples of functions assigned to respective units in each mode, with FIG. 19A showing an example of TV mode and FIG. 19B showing an example of DVD mode.

DESCRIPTION OF THE PREFERRED EMBODIMENTS

Preferred embodiments of the present invention will now be described with reference to the attached drawings. The remote control system according to the present embodiment operates a single operated device using a plurality of remote control units. Here, the expression "operated device" refers to a device, such as a television set or a recording/reproducing apparatus, that can be operated by a remote control apparatus.

Figure 1:
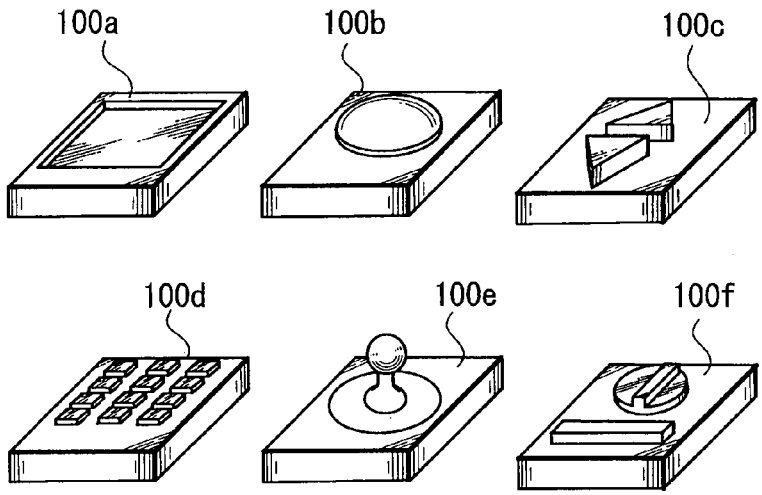
FIG. 1 is a schematic diagram showing examples of remote control units according to an embodiment of the present invention.

In the present embodiment, a plurality of remote control units (hereinafter sometimes referred to as "units") that each include one user interface are used. Such user interfaces are all different. FIG. 1 shows examples of the respective remote control units.

As shown in FIG. 1, a display unit 100*a*, a button unit 100*b*, and an up-down button unit 100*c* are shown from left to right in the upper row. A ten-key unit 100*d*, a joystick unit 100*e*, and a dial unit 100*f* are shown from left to right in the lower row.

The display unit 100*a* is a unit including a display unit formed of an LCD (Liquid Crystal Display) or the like. The button unit 100*b* is a unit equipped with only a single button, and the up-down button unit 100*c* is a unit equipped with two buttons formed of a triangular up button and a triangular down button.

The ten-key unit 100*d* is a unit formed of a ten-key pad on which numbers, symbols, and the like are marked. The joystick unit 100*e* is a unit including a lever that is capable of tilting in any direction of up, down, left, and right. The dial unit 100*f* is a unit including a dial that can be rotated clockwise and anticlockwise. Note that in the following explanation, when it is not necessary to distinguish between the remote control unit 100*a* to the remote control unit 100*f*, such units are collectively referred to as the "remote control units 100".

The types of remote control unit 100 are not limited to the six types described above, and it is also possible to construct a remote control system using units with other user interfaces.

Figure 2:
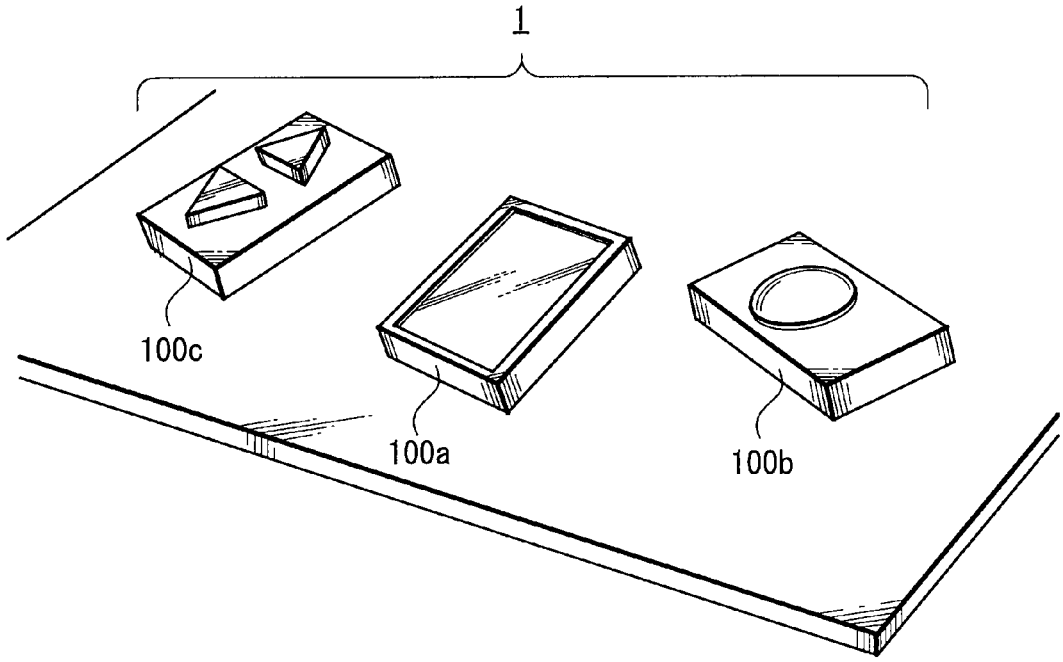
FIG. 2 is a schematic diagram showing an example construction of a system according to an embodiment of the present invention.

By choosing any units 100 in the remote control units 100 with different user interfaces described above, the user can construct a remote control system. In the present embodiment, as shown in FIG. 2, an example is given where the remote control system 1 is constructed of three units, the up-down button unit 100*c*, the display unit 100*a*, and the button unit 100*b*.

The functions assigned to the user interfaces of the respective remote control units 100 are changed as necessary. For example, for the button unit 100*b*, when the operated device is a television set, a button press operation can be assigned to a power on/off function, and when the operated device is a DVD recorder, a button press operation can be assigned to an increase volume function. The respective functions are associated with control commands for realizing such functions, and the control commands and the operation content of a user interface are also associated in advance.

The correspondence between control commands and actual operations (control contents) is written in a "control command-operation correspondence table" and the correspondence between control commands and operation contents is recorded in an "operation input-control command correspondence table" as a first table. Such tables are described in detail later in this specification.

The function assigned to a user interface can also be changed in accordance with the viewing state of the user and a control type for the operated device. In the present embodiment, a plurality of "modes" are provided as classifications according to the type of operated device, the viewing state of the user, the control type for the operated device, and the like. By switching between such "modes", the functions assigned to the respective user interfaces are changed.

"TV mode" and "DVD mode" are provided as modes based on a classification of operated device. Classifications based on the viewing state of the user and/or the control content of the operated device are also provided as "submodes". As the "submodes", "channel switching mode" and "zapping mode" are provided for "TV mode", and "playback mode" and "chapter select mode" are provided for "DVD mode". Note that the types of mode can be optionally set by the user and are not limited to the modes given above.

The functions assigned to the user interface of each remote control unit 100 can be changed not only when the "mode" changes but also when an instruction to change the assignment of functions has been received from the user.

Instructions for changing mode and instructions for changing the assigned functions are received using voice commands. When inputted instructions are received via voice commands, as one example, a control command (hereinafter referred to as a "mode changing command") for actually changing the mode is associated in advance with a voice command such as the spoken words "zapping mode". A control command for changing the functions assigned to an operation input content (hereinafter, "assigned function control command") is associated in advance with a voice command such as the spoken word "assignment".

The "assigned function control command" is a command for causing the unit 100 that has received the command to enter a state where the assignment of functions can be changed. The actual processing that changes the assigned function is then carried out when the operation content to be assigned a new function is designated by the user.

The new function is also designated via a voice command, and the operation content to be newly assigned a function is designated via an operation input of the user interface. For example, when the user wishes to newly assign a next channel function to a pressing operation of the button unit 100*b*, the user says the word "next" while pressing the button of the button unit 100*b*. At this time, the unit 100 carries out processing that links a control command associated with the sound of the word "next" (in this example, a control command that designates switching to the next channel) and the inputted operation content (i.e., a button press operation).

The correspondence between voice commands and control commands is stored in the "voice command-control command correspondence table" as a second table. The processing that associates actual sounds and voice commands and the structure of the "voice command-control command correspondence table" will also be described in detail later.

To receive an instruction for changing mode via a spoken command, one or more of the remote control units 100 need to be provided in advance with a function for receiving a voice input and a function for analyzing the received voice input. It is also necessary to store the "voice command-control command correspondence table" in advance described above inside such unit 100. In the present embodiment, such function is provided in the display unit 100*a*.

Figure 3:
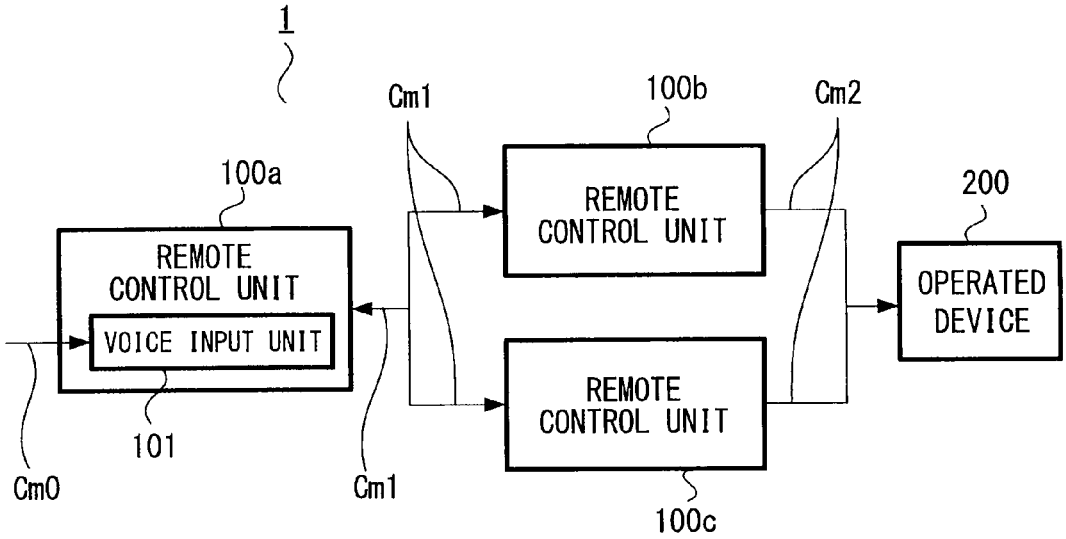
FIG. 3 is a block diagram showing an example configuration of a system according to an embodiment of the present invention.

FIG. 3 is a diagram showing the logical configuration of the remote control system 1 shown in FIG. 2. The display unit 100*a* includes a voice input unit 101, and analyzes a voice command Cm0 inputted by the user, generates a control command Cm1 according to the analyzing result, and transmits the control command Cm1 to the button unit 100*b* and the up-down button unit 100*c*. That is, the control command Cm1 transmitted here is a command associated with the voice command Cm0 in the "voice command-control command correspondence table".

The button unit 100*b* and the up-down button unit 100*c* carry out predetermined processing in accordance with the operation content inputted by the user and the control command Cm1 transmitted from the display unit 100*a*. When the control command Cm1 designates outputting a device control command Cm2, which controls an operation of an operated device 200, to the operated device 200, the button unit 100*b* and the up-down button unit 100*c* output the device control command Cm2. As examples, the device control command Cm2 may be a signal for increasing volume or a signal for switching power on or off.

Note that although an example of a remote control system 1 constructed of the display unit 100*a*, the button unit 100*b*, and the up-down button unit 100*c* is shown in FIGS. 2 and 3, this is merely one example of system construction. For example, it is possible to change the construction of the remote control system 1 by removing any unit from or newly adding a unit to the remote control system 1 shown in FIG. 2.

Figure 4:
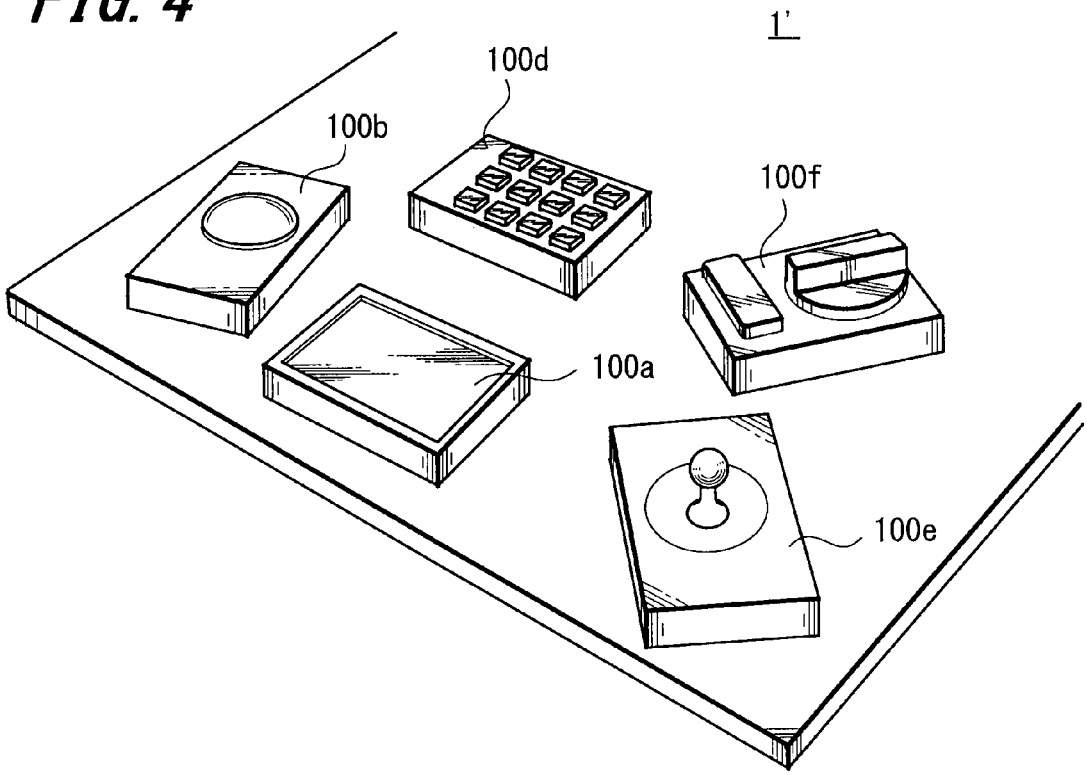
FIG. 4 is a schematic diagram showing an example construction of a system according to an embodiment of the present invention.

FIG. 4 shows an example construction of a remote control system 1' with a different construction. The remote control system 1' shown in FIG. 4 is constructed by removing the up-down button unit 100*c* from the remote control system 1 shown in FIG. 2 and newly adding the ten-key unit 100*d*, the dial unit 100*f*, and the joystick unit 100*e*.

As described above, using a construction where the setting of modes and the functions assigned to the contents of operation inputs can be changed, it is possible to provide the remote control system 1 with expandability.

Figure 5:
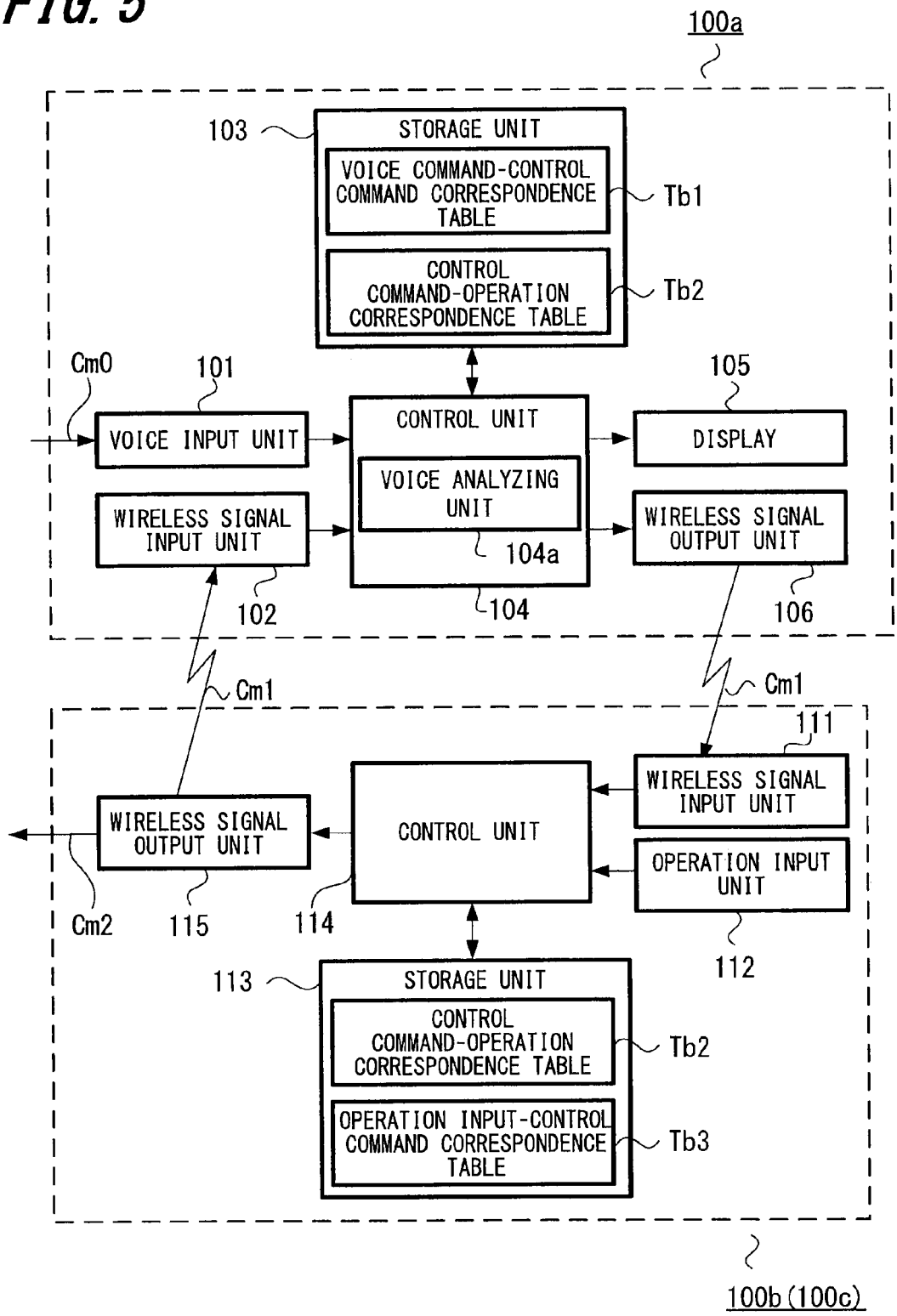
FIG. 5 is a block diagram showing an example of the internal configuration of a system according to an embodiment of the present invention.

Next, an example of the internal configuration of the remote control system 1 according to the present embodiment will be described with reference to FIG. 5. The upper part of FIG. 5 shows an example of the internal configuration of the display unit 100*a*.

The display unit 100*a* includes the voice input unit 101 that inputs speech provided by the user and a wireless signal input unit 102 that receives a control command Cm1 outputted from another unit 100 (in this example, the button unit 100*b* and the up-down button unit 100*c*). The voice input unit 101 is formed of a microphone or the like that converts inputted speech to a speech signal to be outputted.

Note that although the wireless signal input unit 102 is provided in the display unit 100*a* since the use of wireless transmission is intended as a medium for exchanging information with another unit 100 in the present embodiment, the present invention is not limited to this configuration. For example, wires such as cables may be connected between the remote control units 100 and in such case, a wired signal input unit may be provided in place of the wireless signal input unit 102.

The display unit 100*a* further includes a storage unit 103, a control unit 104, a display 105, and a wireless signal output unit 106. The storage unit 103 is a data storage region formed of a non-volatile memory, an HDD (Hard Disk Drive), or the like. Inside the storage unit 103, a voice command-control command correspondence table Tb1 and a control command-operation correspondence table Tb2 are stored.

The control unit 104 is formed of an MPU (Micro Processing Unit) or the like and controls the various components inside the display unit 100*a*. The control unit 104 includes a voice analyzing unit 104*a* that analyzes the inputted speech signal. Based on the analyzing result produced by the voice analyzing unit 104*a*, the control unit 104 reads the control command Cm1 associated with the voice command obtained as the analysis result from the voice command-control command correspondence table Tb1 inside the storage unit 103 and outputs the control command Cm1 to the wireless signal output unit 106.

Also, when a control command Cm1 outputted from another unit 100 has been received via the wireless signal input unit 102, the control unit 104 carries out the operation associated with such control command Cm1 in the control command-operation correspondence table Tb2.

The display 105 is formed of an LCD or the like and displays a program guide for television broadcasts, DVD chapter index images, or the like in accordance with the type of mode that has been set. The wireless signal output unit 106 outputs the control command Cm1 outputted from the control unit 104 to both the button unit 100*b* and the up-down button unit 100*c*.

The lower part of FIG. 5 shows one example of the internal configuration of the button unit 100*b* or the up-down button unit 100*c* have the same configuration aside from the form of the user interface, both units will be described with reference to the same block diagram.

The button unit 100*b* (up-down button unit 100*c*) includes a wireless signal input unit 111, an operation input unit 112, a storage unit 113, a control unit 114, and a wireless signal output unit 115. When a control command Cm1 outputted from the display unit 100*a* is received, the wireless signal input unit 111 outputs the received control command Cm1 to the control unit 114.

The operation input unit 112 is a user interface that receives an operation input from the user. The operation input unit 112 corresponds to the button of the button unit 100*b* and the up button and the down button of the up-down button unit 100*c*.

The storage unit 113 stores the control command-operation correspondence table Tb2 and an operation input-control command correspondence table Tb3. When a control command Cm1 outputted from the display unit 100*a* has been received, the control unit 114 carries out the operation associated in advance with the control command Cm1 in the control command-operation correspondence table Tb2.

When an operation input has been received from the user via a user interface (not shown), the control unit 114 first reads the control command Cm1 associated with the operation content from the operation input-control command correspondence table Tb3. The control unit 114 next carries out the operation associated in advance with the read control command Cm1 in the control command-operation correspondence table Tb2. When the control command Cm1 is a command that designates generation of a device control command Cm2, the appropriate device control command Cm2 is generated.

The wireless signal output unit 115 outputs the device control command Cm2 to the operated device 200 and outputs the control command Cm1 to the display unit 100*a*.

That is, in the remote control system 1 according to the present embodiment, the display unit 100*a* acts as a first remote control unit that interprets a voice command inputted from the user and transfers the command to other units 100. The button unit 100*b* and the up-down button unit 100*c* act as second remote control units.

Note that although an example construction where only the display unit 100*a* is provided with a function for voice recognition is given in the present embodiment, the present invention is not limited to this. For example, all of the units 100 that construct the remote control system 1 may be provided with a voice recognition function.

Next, the detailed configuration and processing of the display unit 100*a* as the first remote control unit will be described with reference to FIGS. 6 to 9. First, the constructions of the respective tables included in the display unit 100*a* will be described with reference to FIGS. 6 to 8, and then the processing of the display unit 100*a* will be described in detail with reference to FIG. 9.

FIG. 6 is a diagram showing an example construction of the voice command-control command correspondence table Tb1 provided in the display unit 100*a*. In the voice command-control command correspondence table Tb1 shown in FIG. 6, the correspondence between different operation contents for the display unit 100*a*, the voice commands Cm0, and the control commands Cm1 is shown. The operation contents are given in the "operation" column, the voice commands Cm0 are given in the "voice command" column, and the control commands Cm1 are given in the "control command" column.

"TV MODE", "CHANNEL SWITCHING", "ZAPPING", "DVD MODE", "PLAYBACK", and "CHAPTER SELECT" in the "operation" column show the names of the "modes", and also indicate a switching operation that switches to the mode shown by the mode name. That is, the control command Cm1 "TV_MODE" associated with the operation called "TV MODE" is a command (mode changing command) that causes a switch to TV mode. The control command Cm1 "TV_MODE" is associated with a voice command of the spoken word "TV". Accordingly, when the spoken word "TV" is inputted as a voice command, the control unit 104 of the display unit 100*a* carries out processing that reads "TV_MODE" as the control command Cm1. The read control command Cm1 is then transmitted to all of the other units 100 (in the present embodiment, the button unit 100*b* and the up-down button unit 100*c*).

"POWER ON/OFF" in the "operation" column refers to an operation that turns the power of the operated device 200 on or off. This operation is associated with the control command Cm1 called "TOGGLE_POWER" and voice commands of the spoken words "POWER" and "ON/OFF". In this way, it is also possible to associate a plurality of voice commands Cm0 with one control command Cm1.

"OPERATION COMMAND ASSIGNMENT" in the "operation" column refers to an operation that changes the function (command) associated with the content of an operation input. This operation is associated with the control command Cm1 called "COMMAND_ASSIGN" and a voice command of the spoken word "ASSIGNMENT". That is, the control command Cm1 called "COMMAND_ASSIGN" corresponds to the "assigned function control command" described above.

"INCREASE VOLUME", "DECREASE VOLUME", "NEXT CHANNEL", and "PREVIOUS CHANNEL" in the "operation" column relate to control operations carried out for a television set. Voice commands Cm0, such as the spoken words "UP" and "DOWN", that are associated with such operations are given by the user when the user wishes to change the assignment of functions. That is, these commands are used to designate the functions to be actually assigned when the user carries out processing that changes the assignment of functions.

"FORWARD PICTURE SEARCH", "REVERSE PICTURE SEARCH" "NEXT CHAPTER", and "PREVIOUS CHAPTER" designate control operations carried out for a DVD recorder, and the voice commands Cm0 for calling such operations are used to designate the functions actually assigned when changing the assignment of functions.

Processing that registers any speech as a voice command is carried out using a GUI (Graphical User Interface) such as that shown in FIG. 7. FIG. 7 shows example of screens displayed on the display 105 of the display unit 100*a*, on a display unit (not shown) of the operated device 200, or the like. A menu for making settings of the units 100 is shown in the screen on the left of FIG. 7.

Here, a state is shown where "REGISTER VOICE COMMAND" is selected using a pointer among "SET OPERATED DEVICE" and "REGISTER VOICE COMMAND" given as "SETTINGS". Once an operation that confirms the selection of "REGISTER VOICE COMMAND" has been carried out by the user, the screen changes to the screen shown on the right in FIG. 7. In the screen on the right in FIG. 7, types of mode are shown as menu items on a level below the "REGISTER VOICE COMMAND" menu item.

On this screen, by moving a pointer up and down, the user can select a mode for which the user wishes to register a voice command among all the modes. When the "START REGISTRATION" button is pressed, the screen changes to a screen (not shown) that receives the registration of a voice command. The user then selects the operation and/or control command Cm1 to be assigned such voice command on the screen, and by pressing a "START REGISTRATION" button or the like, for example, the actual registration processing is carried out.

Next, an example configuration of the control command-operation correspondence table Tb2 provided in the display unit 100*a* will be described with reference to FIG. 8. The control command-operation correspondence table Tb2 shown in FIG. 8 includes two columns, "control command" and "operation". Here, the expression "control command" indicates the control commands Cm1. Operations actually carried out inside the display unit 100*a* when the respective control commands Cm1 are inputted are given in the "operation" column.

"TOGGLE_POWER" given in the "control command" column is assigned to an operation that switches, via a toggle operation, between a state where a screen is displayed by the display 105 and a state where a screen is not displayed. "COMMAND_ASSIGN" is assigned to an operation that recognizes speech inputted following such command as a control command Cm1 (assigned command) for designating a function to be newly assigned.

"TV_MODE" is assigned to an operation that switches the mode set in the display unit 100*a* to "CHANNEL SWITCH- ING MODE", and "TV_CHANNEL_MODE" is assigned to an operation that displays a program guide of television broadcasts on the display 105. "TV_ZAPPING_MODE" is a command for displaying, on the display 105, different programs ("hidden programs") to the program presently being shown on a television set.

The control commands Cm1 referred to thusfar are commands that are extracted based on a voice command Cm0 when such voice command Cm0 is inputted. On the other hand, in some cases control commands Cm1 are supplied from other units 100, and therefore operations carried out based on control commands Cm1 supplied from other units 100 are also defined in the control command-operation correspondence table Tb2.

The respective commands "TV_VOLUME_UP/DOWN", "TV_CHANNEL_PREV/NEXT", "TV_CHANNEL_ZAPPING", "DVD_PLAY_PREV/NEXT", and "DVD_CHAPTER_PREV/NEXT" are inputted from other units 100 via the wireless signal input unit 102.

For example, "TV_VOLUME_UP/DOWN" is assigned to an operation that displays a level of volume that has been changed based on an operation of the unit 100 that transmitted the control command Cm1. "TV_CHANNEL_PREV/NEXT" is assigned to an operation that displays, on the display 105, a program being broadcast on a channel selected based on an operation of the unit 100 that transmitted the control command Cm1.

Figure 9:
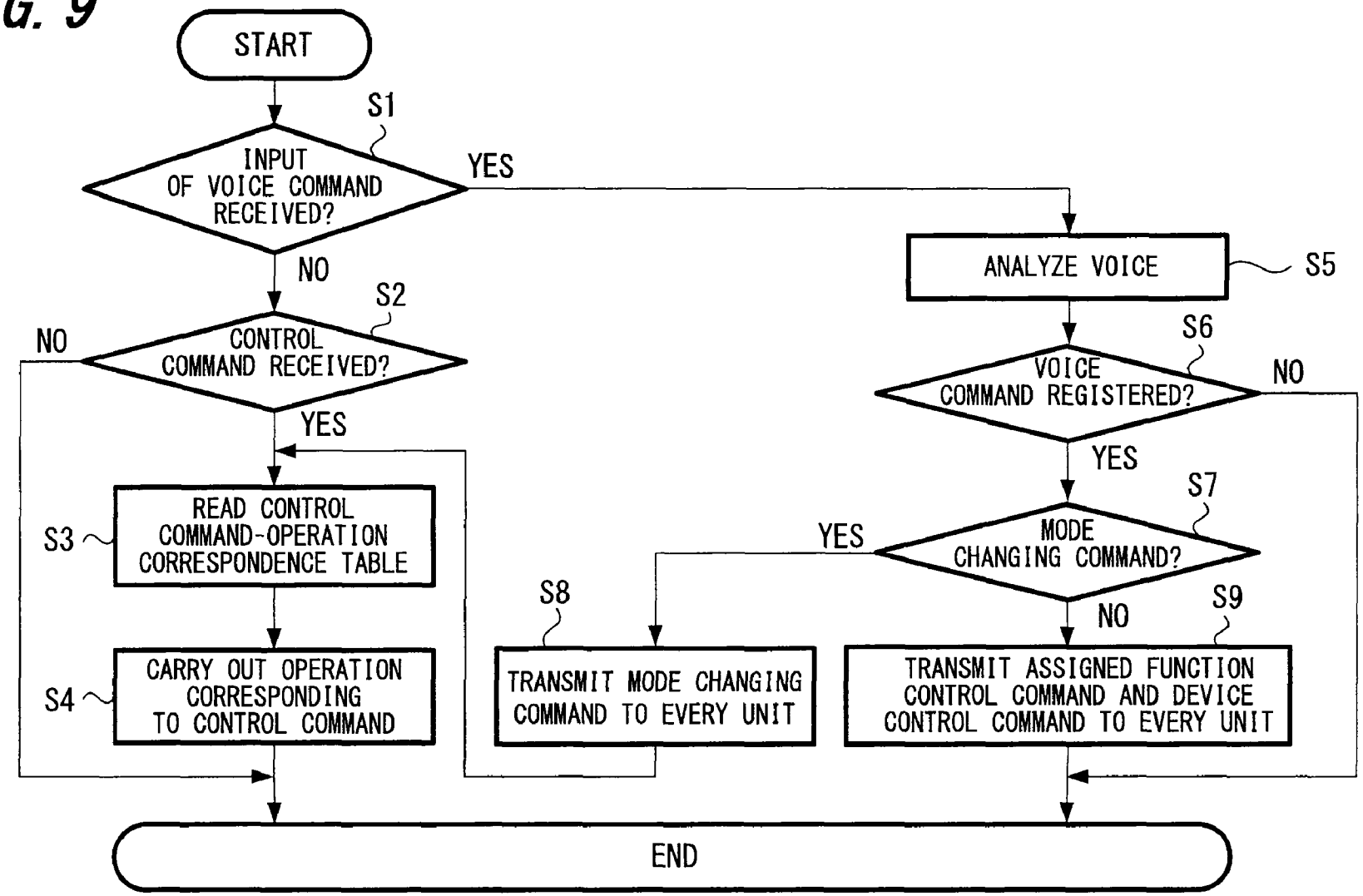
FIG. 9 is a flowchart showing an example of processing by a display unit according to an embodiment of the present invention.

Next, the processing by the display unit 100*a* will be described with reference to the flowchart in FIG. 9. The display unit 100*a* first determines whether a voice command Cm0 has been inputted via the voice input unit 101 (step S1). When the input of a voice command Cm0 has not been received, it is next determined whether a control command Cm1 outputted from another unit 100 has been received (step S2). When a control command Cm1 has not been received, the processing ends at this point. Conversely, when a control command Cm1 has been received, the control command-operation correspondence table Tb2 is read out (step S3) and the operation associated with the control command Cm1 is carried out (step S4).

When it has been determined in step S1 that an input of a voice command Cm0 has been received, voice analysis is then carried out by the voice analyzing unit 104*a* (step S5). After this, it is determined whether the analyzed speech has already been registered as a voice command Cm0 (step S6) and if the inputted speech is not registered as a voice command Cm0, the processing ends.

When the analyzed speech has already been registered as a voice command Cm0, it is then determined whether the control command Cm1 associated with such voice command Cm0 is a mode changing command (step S7). When the control command Cm1 associated with the voice command Cm0 is a mode changing command such as "TV_MODE" or "DVD_PLAY_MODE", processing that outputs such command to every other unit 100 is carried out (step S8).

Next, the processing proceeds to step S3. That is, the control command-operation correspondence table Tb2 is read (step S3) and the operation associated with the control command Cm1 is carried out (step S4). When the control command Cm1 is "DVD_MODE" for example, the operation "display DVD subtitle information" associated with "DVD_PLAY_MODE" in the control command-operation correspondence table Tb2 is carried out.

When it has been determined in step S7 that the control command Cm1 associated with the voice command Cm0 is not a mode changing command, the control command Cm1 is an assigned function control command or a control command Cm1 that is inputted continuing an assigned function control command. Accordingly, processing that transmits the assigned function control command ("COMMAND_ASSIGN") and the control command Cm1 to every other unit 100 is carried out (step S9).

Next, the configuration and processing of the button unit 100*b* and the up-down button unit 100*c* as second remote control units will be described with reference to FIGS. 10 to 19. First, the construction of the tables included in the button unit 100*b* and the up-down button unit 100*c* will be described with reference to FIGS. 10 to 13. After this, the processing of the button unit 100*b* and the up-down button unit 100*c* will be described in detail with reference to FIGS. 14 to 19.

FIG. 10 shows an example of the control command-operation correspondence table Tb2 in the button unit 100*b* and FIG. 11 shows an example of the control command-operation correspondence tables Tb2 is the same as in the display unit 100*a*, description thereof is omitted.

In the present embodiment, since the button unit 100*b* has a path for outputting commands to a television set, processing that relates to control of a television set is defined in the control command-operation correspondence table Tb2 shown in FIG. 10. For the button unit 100*b*, the control command Cm1 "TOGGLE_POWER" is associated with an operation that turns the power of a television set on and off. "COMMAND_ASSIGN" is assigned to an operation that associated a function designated by the control command Cm1 inputted next with an operation content inputted via the operation input unit 112.

"TV_MODE" is associated with an operation that outputs a device control command Cm2 to a television set to switch the input source for inputting a video signal to the tuner of the television set. Conversely, "DVD_MODE" is associated with an operation that outputs a device control command Cm2 to a television set to switch the input source for inputting a video signal to a DVD recorder.

"TV_VOLUME_UP/DOWN" sets an operation that outputs a device control command Cm2 that designates an increase or decrease in volume to a television set, and "TV_CHANNEL_PREV/NEXT" sets an operation that outputs a device control command Cm2 for switching channel. "TV_CHANNEL_ZAPPING" is associated with an operation that switches channels so that the channel number increases.

In the present embodiment, since the up-down button unit 100*c* has a path for outputting commands to a DVD recorder, processing that relates to control of a DVD recorder is defined in the control command-operation correspondence table Tb2 shown in FIG. 11.

In the up-down button unit 100*c*, "TOGGLE_POWER" is associated with an operation that turns the power of a DVD recorder on and off. "COMMAND_ASSIGN" is assigned the same operation as in the button unit 100*b*.

"DVD_PLAY_MODE" is associated with an operation that outputs a device control command Cm2 that designates a start of playback to the DVD recorder. "DVD_PLAY_PREV/NEXT" sets an operation that outputs a device control command Cm2 for forward or reverse picture search. "DVD_CHAPTER_PREV/NEXT" is associated with an operation that changes the chapter in a content played back by a DVD recorder so that the chapter number increases or decreases.

Next, an example construction of the operation input-control command correspondence tables Tb3 in the button unit 100*b* and the up-down button unit 100*c* will be described with reference to FIGS. 12A, 12B and FIGS. 13A, 13B. The operation input-control command correspondence table Tb3 sets the correspondence between the operation content inputted into the operation input unit 112 and the control command Cm1 for each type of mode.

FIGS. 12A and 12B show example constructions of the operation input-control command correspondence table Tb3 in the button unit 100*b*. FIG. 12A shows correspondence information for button press operations and control commands in the case where TV mode has been selected. According to the setting shown in FIG. 12A, when channel switching mode has been selected as a submode of TV mode, a "TOGGLE_POWER" command is carried out every time a button press operation is received. Conversely, when zapping mode has been selected as a submode of TV mode, a "TV_CHANNEL_ZAPPING" command is carried out every time a button push operation is received.

According to the control command-operation correspondence table Tb2 shown in FIG. 10, an operation that outputs the device control command Cm2 for turning the power of a TV set on and off is assigned to "TOGGLE_POWER". Accordingly, when channel switching mode is selected, whenever the user presses the button of the button unit 100*b*, the power of the TV receiver is turned on or off according to a toggle operation.

"TV_CHANNEL_ZAPPING" is associated with an operation that switches between channels of a TV set so that the channel number increases. For this reason, in a state where zapping mode has been selected, whenever the user presses the button of the button unit 100*b*, the channel is changed in order.

In the button unit 100*b* that includes the control command-operation correspondence table Tb2 constructed in this way, when an instruction to change mode has been received from a user via the display unit 100*a*, processing that changes the table in use is carried out. For example, when a selection of chapter select mode has been designated by the user, the table shown in FIG. 12B is selected as the operation input-control command correspondence table Tb3.

As shown in FIG. 12B, the correspondence between operation contents of the operation input unit 112 and operations (commands) to be carried out is also registered in different combinations for the respective submodes within DVD mode.

FIGS. 13A and 13B show example constructions of the operation input-control command correspondence tables Tb3 of the up-down button unit 100*c*. FIG. 13A shows an example of a table used when TV mode is selected and FIG. 13B shows an example of a table used when DVD mode is selected. Since the up-down button unit 100*c* has two types of user interface, an up button and a down button, an operation (command) assigned to an operation input content is set for each type of button.

According to the settings shown in FIG. 13B, when chapter select mode is selected as a submode of DVD mode, the control command Cm1 "DVD_CHAPTER_PREV" is carried out in response to a press operation of the up button. Similarly, the control command Cm1 "DVD_CHAPTER_NEXT" is carried out in response to a press operation of the down button.

According to the control command-operation correspondence table Tb2 shown in FIG. 11, "DVD_CHAPTER_PREV" is assigned to an operation that switches between chapters in the content played back by a DVD recorder so that the chapter number increases. Accordingly, when chapter select mode has been selected within DVD mode, when the up button of the up-down button unit 100*c* has been pressed, in response to such operation, the chapter in the content is switched so that the chapter number increases in order.

"DVD_CHAPTER_NEXT" is assigned to an operation that switches between chapters in the content played back by a DVD recorder so that the chapter number decreases. Accordingly, when chapter select mode has been selected within DVD mode, when the down button of the up-down button unit 100*c* has been pressed, in response to such operation, the chapter in the content is switched so that the chapter number decreases in order.

Next, the processing by the button unit 100*b* or the up-down button unit 100*c* that includes the control command-operation correspondence table Tb2 and the operation input-control command correspondence table(s) Tb3 described above will be described with reference to FIG. 14.

In the button unit 100*b* and the up-down button unit 100*c* as the second remote control unit, it is first determined whether an assigned function control command has been transmitted from the display unit 100*a* as the first remote control unit (step S11). When an assigned function control command has been received, command assignment changing processing that is predefined processing is carried out (step S12).

When an assigned function control command has not been received, mode changing processing that is predefined processing is carried out (step S13) and then device control command extracting processing that is also predefined processing is carried out (step S14). Finally, the device control command extracted by the device control command extracting processing is transmitted (step S15).

Figure 15:
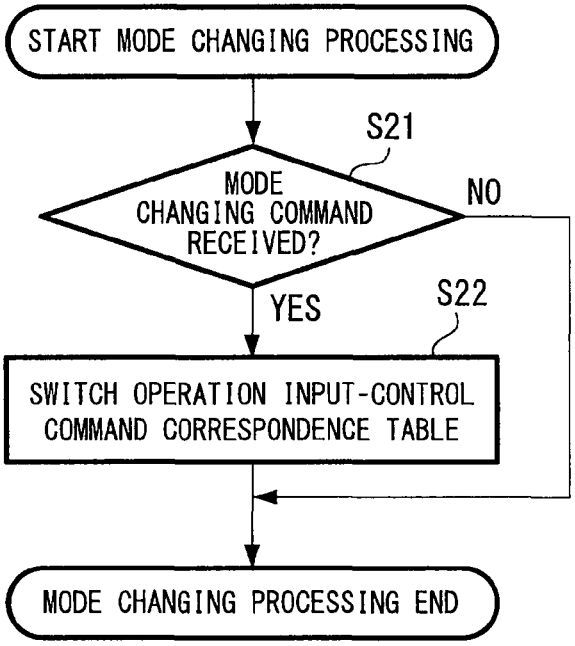
FIG. 15 is a flowchart showing an example of mode changing processing according to an embodiment of the present invention.

First, the "mode changing processing" as predefined processing will be described in detail with reference to FIG. 15. In the mode changing processing, it is first determined whether a mode changing command transmitted from the display unit 100*a* has been received (step S21). When a mode changing command has not been received, the "mode changing processing" ends at this point. Conversely, when a mode changing command has been received, processing that switches the operation input-control command correspondence table Tb3 in accordance with the content of the mode changing command is carried out (step S22).

A mode changing command is a control command Cm1 whose command name ends in "MODE", and examples of such commands are "TV MODE", "DVD_MODE", "TV_ZAPPING_MODE", and the like. When one of such commands has been inputted from the display unit 100*a*, the table used as the operation input-control command correspondence table Tb3 shown in any of FIGS. 12A to FIG. 13B is switched to a table used for the selected mode. For example, when the control command Cm1 (DVD_MODE) that designates a switch to DVD mode has been inputted in a state where the table for TV mode shown in FIG. 12A has been selected, the operation input-control command correspondence table Tb3 is switched to the table shown in FIG. 12B.

By carrying out the processing described above, the functions assigned to each unit 100 are automatically changed in accordance with the mode changing processing. Accordingly, when the type of operated device 200 or the viewing state changes, the user no longer needs to manually and individually change the functions assigned to the units 100.

Figure 16:
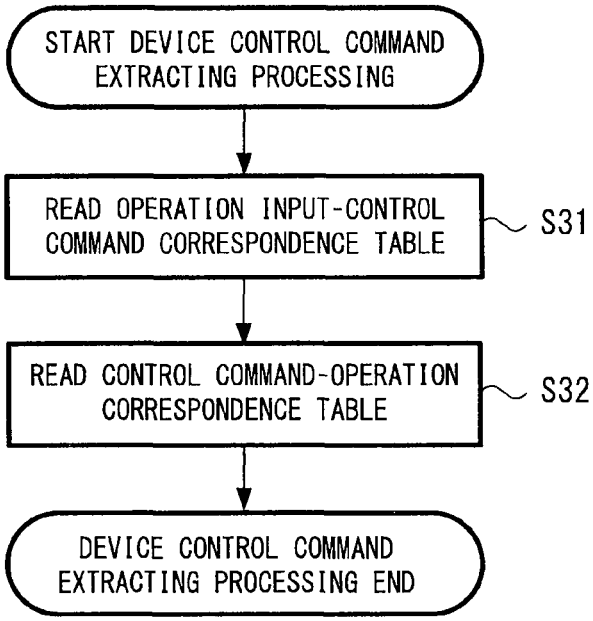
FIG. 16 is a flowchart showing an example of device control command extracting processing according to an embodiment of the present invention.

Next, an example of predefined "device control command extracting processing" will be described with reference to FIG. 16. In the device control command extracting processing, an appropriate control command Cm1 is extracted from the operation input-control command correspondence table Tb3 in accordance with the operation content inputted via the operation input unit 112 (step S31). Next, by reading the control command-operation correspondence table Tb2 (step S32), the device control command Cm2 associated with the control command Cm1 is extracted.

For example, for the up-down button unit 100*c*, a state where "chapter select mode" has been selected and the operation input-control command correspondence table Tb3 shown in FIG. 13B is used is imagined. At this time, when the up button is pressed by the user, in step S31, "DVD_CHAPTER_PREV" associated with a pressing operation for the up button is associated with "DVD_CHAPTER_PREV" is extracted from the control command-operation correspondence table Tb2 (see FIG. 11) by the processing in step S32.

In the control command-operation correspondence table Tb2, a device control command Cm2 for advancing or returning between chapters in the content being reproduced by the DVD recorder is associated with the control command Cm1 "DVD_CHAPTER_PREV/NEXT". Accordingly, such device control command Cm2 is extracted in step S32.

Figure 14:
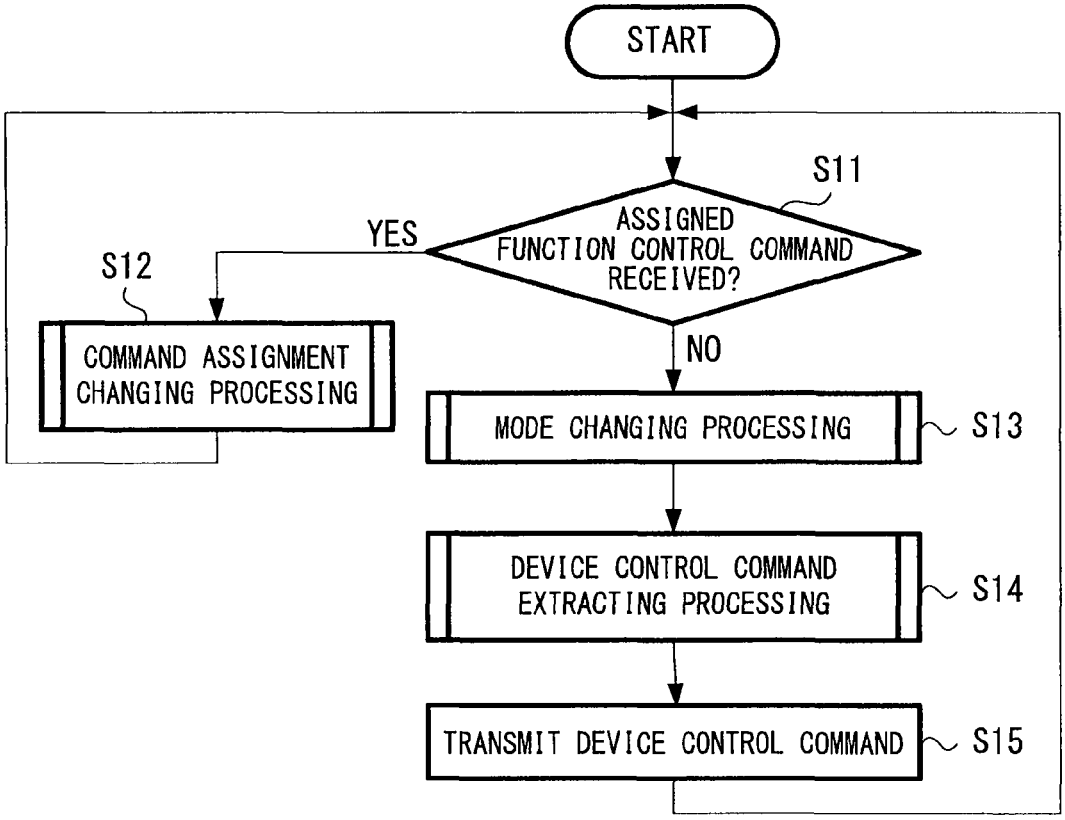
FIG. 14 is a flowchart showing an example of processing by a second remote control unit according to an embodiment of the present invention.

According to the flowchart shown in FIG. 14, after the "device control command extracting processing" has been carried out, the extracted device control command is transmitted (step S15). That is, a device control command Cm2 for causing an advance or return between chapters in the content played back by a DVD recorder is transmitted to the DVD recorder as the operated device 200.

Figure 17:
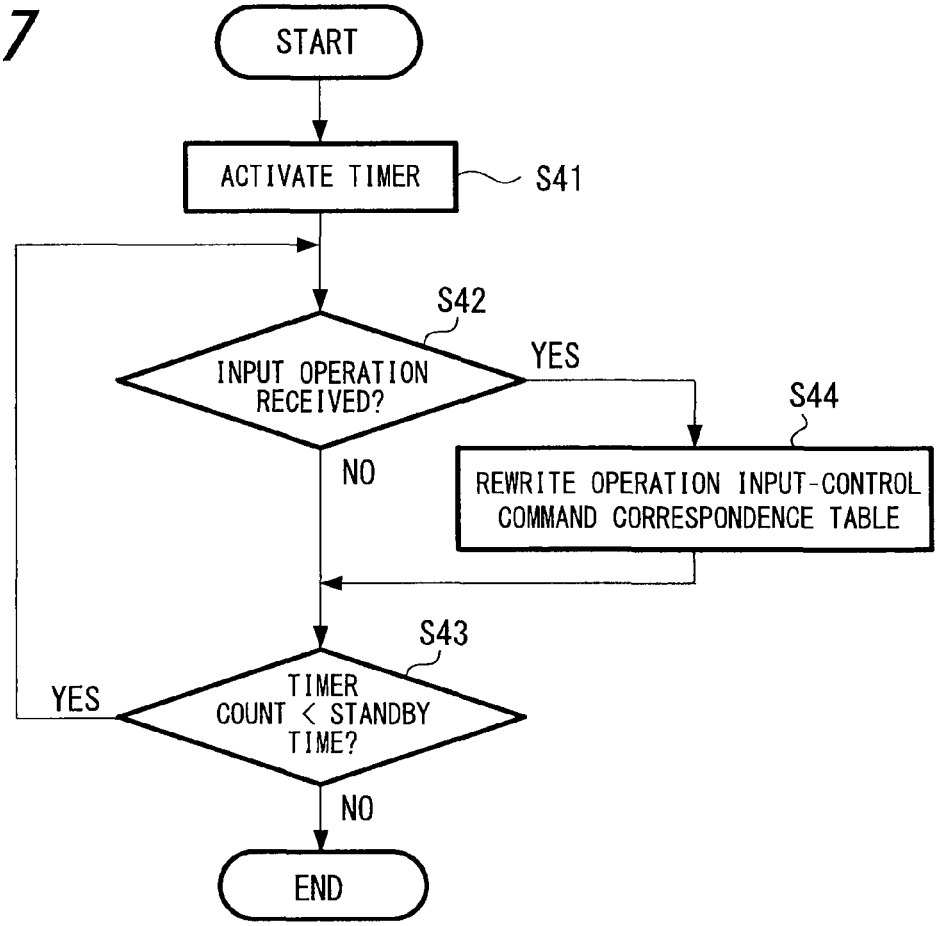
FIG. 17 is a flowchart showing an example of command assignment changing processing according to an embodiment of the present invention.

Next, an example of "command assignment changing processing" that is predefined processing will be described with reference to FIG. 17. In the command assignment changing processing, first a timer (not shown) is activated (step S41) and it is determined whether an input operation has been received by the operation input unit 112 (step S42).

When an input has not been received by the operation input unit 112, it is determined whether the time counted by the timer is another than the time set in advance as a "standby time" (step S43). So long as the time being counted by the timer is shorter than the period set as the standby time, the processing returns to step S42 and continues thereafter. When the time counted by the timer exceeds the periods set as the standby time, the processing ends.

If, after an assigned function control command has been received, an input operation has not been received by the operation input unit 112 by the time a predetermined period has elapsed, it is assumed that the apparatus whose assignment of functions is to be changed is not the present apparatus. That is, the user have made an operation input on another apparatus whose assignment of functions is to be changed. Accordingly, in this case, the command assignment changing processing ends.

When it has been determined in step S42 that an operation has been received by the operation input unit 112, processing that rewrites the operation input-control command correspondence table Tb3 using the control command Cm1 inputted following the assigned function control command is carried out (step S44).

That is, when there has been an input into the operation input unit 112 before a predetermined period has elapsed following the reception of an assigned function control command outputted from the display unit 100*a*, the function designated by the control command Cm1 is assigned as a new function. After this, the assigned function continues to be used until removal of such assignment is designated or a new function is assigned.

FIG. 18 shows an example construction of the operation input-control command correspondence table Tb3 before and after the "command assignment processing". The operation input-control command correspondence table Tb3 shown in FIG. 18 is provided in the button unit 100*b*. The control command Cm1 associated with channel switching mode within TV mode is "TOGGLE_POWER" in the upper table in FIG. 18 and "TV_VOLUME_UP/DOWN" in the lower table.

This change is realized by the user first saying the word "assignment" and then making a button press operation of the button unit 100*b* while saying the word "up" or "down".

The spoken word "assignment" is first recognized as a voice command Cm0 by the display unit 100*a* that includes the voice recognition function. After this, the control command Cm1 associated with the voice command Cm0 in the voice command-control command correspondence table Tb1 is extracted and such control command Cm1 is outputted to the button unit 100*b* and the up-down button unit 100*c*. According to the voice command-control command correspondence table Tb1 shown in FIG. 6, the control command Cm1 associated with the voice command "assignment" is "COMMAND_ASSIGN" (the assigned function control command). Accordingly, "COMMAND_ASSIGN" as the control command Cm1 is outputted to every unit 100.

The button unit 100*b* and the up-down button unit 100*c* that have received "COMMAND_ASSIGN" carry out the processing shown by the flowchart in FIG. 14. Since the assigned function control command has been received, "YES" is selected in step S11 and the processing proceeds to the command assignment changing processing in step S12. In the command assignment changing processing, the processing shown in FIG. 17 is carried out. In the button unit 100*b* and the up-down button unit 100*c*, respectively, first the timer is activated (step S41) and it is determined whether an operation of the operation input unit 112 has been received (step S42). In the button unit 100*b*, since a button press operation has been received, processing that rewrites the operation input-control command correspondence table Tb3 is carried out (step S44).

That is, as shown in FIG. 18, processing is carried out to rewrite the control command Cm1 associated with the present mode in the operation input-control command correspondence table Tb3 to the control command Cm1 corresponding to the voice command Cm0 "up" or "down". According to the voice command-control command correspondence table Tb1 shown in FIG. 6, "TV_VOLUME_UP" is associated with "up" and "TV_VOLUME_DOWN" is associated with "down". Therefore, according to the voice command spoken together with the operation input, "TV_VOLUME_UP" or "TV_VOLUME_DOWN" is assigned as the new function.

In the up-down button unit 100*c*, if no operation input is made by the user, the count time counted by the timer will exceed a predetermined period set in advance as the standby period. Accordingly, "No" is selected in step S43 in FIG. 17, the assigning of a command is not carried out in the up-down button unit 100*c*, and processing is terminated.

According to the present embodiment described above, a single function such as "power on/off" is assigned to a remote control unit including a single user interface. In this case, if a function is assigned in accordance with the characteristics of the unit, the user will be able to suitably grasp the correspondence between the unit and the function(s) assigned thereto.

For example, the "power on/off" function is assigned to the button unit 100*b* or the like with a user interface that is suitable for carrying out a toggle operation. By making such setting in advance, the user can intuitively select the button unit 100*b* when carrying out an actual power on/off operation. That is, the unit for realizing the operation that the user wishes to carry out can be intuitively selected based on visual information, i.e., the appearance of the unit.

According to the embodiment described above, different functions relating to control of a single operated device 200 are assigned to a plurality of units 100 including respectively different user interfaces. Accordingly, it is possible to assign only optional functions in the functions for controlling the operated device 200 to each unit 100. For example, if the user only wishes to carry out a power on/off operation and a channel select operation for a television set, it is possible to construct a system with two units, that is, a unit 100 assigned the power on/off function and a unit 100 assigned the channel switching function. That is, it is possible to flexibly construct the system in accordance with the user's needs.

In this case, since the units are physically separated, it will be possible for the user to readily select the units required by the user himself/herself. This means that even when a new function has been added to the operated device 200 for example, by merely adding a new unit 100 assigned such function, it becomes possible to carry out an operation corresponding to the new function. That is, the system has expandability.

At such time, it is possible to continue using existing units 100 aside from the newly added unit 100 with no changes to the settings. Accordingly, even when a new function has been added, the user will be able to control the operated device 200 with operations that are familiar to the user.

Also, since the respective units are physically separated, it is also possible to cause the operated device 200 to carry out a desired operation by simultaneously operating a plurality of units. For example, a function that changes a zoom ratio of video displayed on a screen is assigned to the button unit 100*b* and a function for moving the zoom position is assigned to the joystick unit 100*e*. By making such settings, it becomes possible for the user to simultaneously carry out operations on the zoom ratio and the zoom position by operating different units 100 in his/her left and right hands.

Also, according to the present embodiment described above, the functions assigned to each unit can be changed in each mode provided in accordance with the type of operated device 200 and the type of viewing state of the user. FIGS. 19A and 19B show an example setting of the assigned functions in each mode in a system constructed of the display unit 100*a*, the button unit 100*b*, and the up-down button unit 100*c*.

FIG. 19A shows an example of the functions assigned to each unit 100 in "TV mode". In "channel switching mode", a "display program guide" function is assigned to the display unit 100*a*, a "power on/off" function is assigned to the button unit 100*b*, and a "channel switching" function is assigned to the up-down button unit 100*c*. In "zapping mode", a "display hidden program" function is assigned to the display unit 100*a*, a "next channel" function is assigned to the button unit 100*b*, and an "adjust volume" function is assigned to the up-down button unit 100*c*.

FIG. 19B shows an example of the functions assigned to each unit 100 in "DVD mode". In "playback mode", a "display subtitles" function is assigned to the display unit 100*a*, a "play/stop" function is assigned to the button unit 100*b*, and a "forward/reverse picture search" function is assigned to the up-down button unit 100*c*. In "chapter select mode", a "display hidden program guide" function is assigned to the display unit 100*a*, a "play/stop" function is assigned to the button unit 100*b*, and a "chapter select" function is assigned to the up-down button unit 100*c*.

That is, a mode can be set in accordance with the type of operated device 200, the type of user viewing state, and the type of control content, and it is possible to change the functions assigned to each unit 100 in the respective modes. By changing the selection of mode, the functions assigned to each unit 100 are automatically switched. By doing so, it is possible to optimally construct a system in accordance with the type of operated device 200 and the viewing state.

According to the present embodiment described above, the user can change the functions assigned to the units 100. Therefore, when the user wishes to newly control a function that would not be operated in a remote control system 1 that has already been constructed but does not have a unit assigned such function to hand, it will be possible to substitute the function provided in the original unit 100 into the unit 100 the user has to hand.

That is, in accordance with an instruction from the user, it is possible to provide the display unit 100*a* with a function that displays a table such as those shown in FIGS. 19A and 19B on the screen. By carrying out such display, since it is possible to easily confirm the functions assigned to the units, it is possible to prevent the user from making erroneous operations.

According to the present embodiment described above, it is possible to switch between modes and to change the functions assigned to units 100 via voice commands. This means it is possible to make such selections smoothly even when a plurality of modes are present.

In this case, even when a plurality of items relating to control or settings of the operated device 200 are provided on many levels in a hierarchy, it is possible to select the desired item via voice input. For example, when a function called "display chapter index images" is set on a deep level in the menu hierarchy, with existing technology an operation that traces a route through the levels from the top level was required. According to an embodiment of the present invention however, it is possible to easily select the desired function without having to carry out such troublesome operation.

Although the voice commands Cm0 are used only when the mode is changed or when the assigned functions are changed in the present embodiment described above, it is also possible to use a construction where normal operations carried out by a remote control unit 100 can be designated using voice commands Cm0. By using such construction, it becomes possible to use both voice commands Cm0 and operation inputs to efficiently operate the operated device 200.

For example, the joystick unit 100*e* is provided with a voice recognition function and a zoom center position moving function. When such setting is used, by saying words such as "zoom" and "wide" while setting the center position of the zoom according to an operation of the joystick unit 100*e*, it becomes possible to simultaneously adjust the zoom ratio on the screen.

Note that although an example of a construction where changes of mode and changes to the functions assigned to the units 100 are carried out using the voice commands Cm0 is given in the present embodiment described above, it is also possible to use a construction where such processes are designated by operation inputs.

The present application contains subject matter related to that disclosed in Japanese Priority Patent Application JP 2008-106981 filed in the Japanese Patent Office on Apr. 16, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A remote control system comprising:

at least one first remote control apparatus including a command input unit into which a user inputs a command, a first control unit that determines a control command based on a content of the command inputted via the command input unit, and a first output unit that outputs the control command determined by the first control unit to another apparatus; and at least one second remote control apparatus including a first user interface unit that is a user interface portion and is assigned an operation for controlling one function in a plurality of functions of a device operated by the second remote control apparatus, a first input unit in which a control command transmitted from the at least one first remote control apparatus is inputted, a second control unit that carries out processing based on an operation content inputted via the first user interface unit and the control command inputted via the first input unit, and a second output unit operable when a device control command for controlling the device operated by the second remote control apparatus has been generated by the processing carried out by the second control unit, to output the device control command to the device.

2. A remote control system according to claim 1, wherein the at least one second remote control apparatus includes a plurality of second remote control apparatuses and the first user interface units of the plurality of second remote control apparatuses are respectively different.

3. A remote control system according to claim 2, wherein the command inputted into the command input unit is a voice command.

4. A remote control system according to claim 3, wherein the at least one first remote control apparatus further includes:

a second user interface unit that is a user interface portion and is assigned an operation for controlling one function in the plurality of functions of a device operated by the first remote control apparatus, and a second input unit in which a control command transmitted from the at least one second remote control apparatus is inputted; and wherein the first output unit is operable when a device control command for controlling the device operated by the first remote control apparatus has been generated by the processing carried out by the first control unit, to output the device control command to the device.

5. A remote control system according to claim 4, wherein the first control unit is operable when a voice command that designates a change of function assigned to the operation content has been received by the command input unit, to output, as the control command, a function assigning command for changing the function assigned to the operation content to the first output unit and to output, as the control command, a function designated by the user via the command input unit as a function to be newly assigned to the operation content to the first output unit; and wherein the first output unit transmits the function assigning command and the control command to the at least one second remote control apparatus.

6. A remote control system according to claim 5, wherein the first control unit and the second control unit are operable, when a newly inputted control command has been received via one of the first input unit and the second input unit after the function assigning command has been received via one of the first input unit and the second input unit and an operation input from the user has also been received via one of the first user interface unit and the second user interface unit, to overwrite the control command, which was associated in advance with the operation content, using the newly inputted control command.

7. A remote control system according to claim 4, wherein the at least one first remote control apparatus and the at least one second remote control apparatus each include a first table in which associations between each control command and each operation content inputted via one of the first user interface unit and the second user interface unit are indicated.

8. A remote control system according to claim 7, wherein the at least one first remote control apparatus includes a second table in which associations between commands inputted via the command input unit and each control command are indicated.

9. A remote control system according to claim 8, wherein the at least one first remote control apparatus and the at least one second remote control apparatus each include a plurality of modes set in accordance with a type of the device and types of control content for the device, and a content of the first table differs in each mode.

10. A remote control system according to claim 9, wherein the first control unit and the second control unit are operable, when an operation input has been received via one of the first user interface unit and the second user interface unit, to extract a control command associated with a specified mode in accordance with a content of the operation input.

11. A remote control system according to claim 10, wherein the first control unit of the at least one first remote control apparatus is operable when a command designating a change of the mode has been received via the command input unit, to output a mode changing command for changing the mode to the first output unit; and wherein on receiving the mode changing command, the first control unit of the at least one first remote control apparatus switches the first table to a table corresponding to the mode designated by the mode changing command, and on receiving the mode changing command, the second control unit of the at least one second remote control apparatus switches the first table to a table corresponding to the mode designated by the mode changing command.

12. A remote control system according to claim 4, wherein the command input unit is a voice input unit into which speech provided by the user is inputted;

wherein the at least one first remote control apparatus further includes a voice analyzing unit that analyzes the speech inputted via the voice input unit; and wherein the first control unit associates the speech with the voice command based on a result of analysis by the voice analyzing unit and extracts a control command associated in advance with the voice command.

13. A remote control system according to claim 4, wherein the first user interface unit of the at least one second remote control apparatus is formed of a display unit that displays information relating to an operation of the device carried out in accordance with a content of a device control command outputted from the at least one first remote control apparatus.

14. A remote control signal processing method comprising the steps of:

receiving a command from a user via a first remote control apparatus;

determining, based on the inputted command, a control command in accordance with a content of the command;

outputting the determined control command to a second remote control apparatus that differs from the first remote control apparatus;

receiving an operation input from a user interface unit assigned an operation for controlling one function in a plurality of functions of a device operated by the second remote control apparatus;

receiving the control command transmitted from the first remote control apparatus;

carrying out processing, based on an operation content inputted via the user interface unit and the control command transmitted from the first remote control apparatus, associated in advance with the operation content and the control command; and outputting, when a device control command for controlling the device has been generated by the processing, to output the device control command to the device.

15. A remote control system comprising:

at least one first remote control apparatus including a command input unit into which a user inputs a command, a first control unit that determines a control command based on a content of the command inputted via the command input unit, and a first output unit that outputs the control command determined by the first control unit to another apparatus; and at least one second remote control apparatus including a first user interface unit that is a user interface portion and is assigned an operation for controlling one function in a plurality of functions of a device operated by the second remote control apparatus, a first input unit in which a control command transmitted from the at least one first remote control apparatus is inputted, means for processing based on an operation content inputted via the first user interface unit and the control command inputted via the first input unit, and a second output unit operable when a device control command for controlling the device operated by the second remote control apparatus has been generated by the processing carried out by the second control unit, to output the device control command to the device.

* * * * *